US007380533B2

(12) United States Patent
Tsubouchi et al.

(10) Patent No.: US 7,380,533 B2
(45) Date of Patent: Jun. 3, 2008

(54) OUTBOARD MOTOR PROVIDED WITH INTERNAL COMBUSTION ENGINE HAVING ELECTRICAL EQUIPMENT BOX

(75) Inventors: Masanori Tsubouchi, Wako (JP); Akifumi Fujima, Wako (JP); Kei Inoue, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/787,139

(22) Filed: Apr. 13, 2007

(65) Prior Publication Data

US 2007/0251486 A1 Nov. 1, 2007

(30) Foreign Application Priority Data

Apr. 28, 2006 (JP) ..... 2006-126606

(51) Int. Cl.
*F02B 61/04* (2006.01)
*F02B 77/04* (2006.01)

(52) U.S. Cl. ..... 123/195 P; 123/198 E

(58) Field of Classification Search ..... 123/195 HC, 123/195 P, 198 E, 196 W
See application file for complete search history.

(56) References Cited

U.S. PATENT DOCUMENTS 6,213,826 B1 * 4/2001 Koishikawa et al. ... 123/196 W
6,302,749 B1 * 10/2001 Tawa et al. ..... 440/76
6,964,255 B2 * 11/2005 Shomura et al. ..... 123/198 E

FOREIGN PATENT DOCUMENTS

JP 02-274689 11/1990

* cited by examiner

*Primary Examiner*—Noah P. Kamen
(74) *Attorney, Agent, or Firm*—Carrier, Blackman & Associates, P.C.; Joseph P. Carrier; William D. Blackman

(57) ABSTRACT

An outboard motor S has an exhaust manifold passage 37 for carrying exhaust gas from combustion chambers 30. The exhaust manifold passage 37 is formed in a part of a cylinder head 22 in an exhaust-side part of an internal combustion engine E on the side of the cylinder head 22 with respect to a joint surface P of a cylinder block 20 joined to the cylinder head 22. An exhaust passage 38 is formed in the cylinder block 20 and connected to the exhaust gas outlet 37*e* of the exhaust manifold passage 37 in the joint surface P. An electrical equipment box 50 holding electrical equipment is placed in the exhaust-side part so as to overlap the exhaust passage 38 when viewed in vertical direction. An electrical equipment box 50 is disposed adjacent to the cylinder head 22 with respect to the direction parallel to the axes of cylinders 20*a*. It is thus possible to increase freedom of arranging parts at positions farther from the cylinder head than the electrical equipment box and freedom of determining the sizes of those parts.

5 Claims, 3 Drawing Sheets

OUTBOARD MOTOR PROVIDED WITH INTERNAL COMBUSTION ENGINE HAVING ELECTRICAL EQUIPMENT BOX

BACKGROUND OF THE INVENTION

1. Field of the Invention

The present invention relates to an outboard motor provided with an internal combustion engine including a cylinder block provided with cylinders in an in-line arrangement, a cylinder head, and an electrical equipment box holding electrical equipment therein. More specifically, the present invention relates to the layout of an engine body including a cylinder block and a cylinder head, and an electric equipment box.

2. Description of the Related Art

There has been known an outboard motor provided with an internal combustion engine including a cylinder block provided with cylinders in an in-line arrangement, a cylinder head, a vertical crankshaft having a vertical axis, and an electrical equipment box holding electrical equipment therein. A vertical plane containing the horizontal center axis of the outboard motor divides the internal combustion engine into an intake-side part and an exhaust-side part. The cylinder block is provided with an exhaust manifold passage. The electrical equipment box is placed in the exhaust-side part. This type of outboard motors is disclosed in, for example, Japanese Patent Application Publication No. 2-274689.

In case the electrical equipment box is placed in the exhaust-side part and the exhaust manifold passage is formed in the cylinder block, the disposition of the electrical equipment box near the cylinder head with respect to a direction parallel to the axes of the cylinders is obstructed by walls defining the exhaust manifold passages. Consequently, restrictions are imposed on the position and size of an intake system which includes an inlet air silencer and is disposed on the front side of the electrical equipment box positioned in front of the cylinder head. When the electrical equipment box is disposed transversely apart from the center axis of the outboard motor to avoid interference of the electrical equipment box with the intake system and the walls defining the exhaust manifold passage, the transverse width and the weight of the outboard motor increase.

SUMMARY OF THE INVENTION

The present invention has been made under such circumstances and it is therefore an object of the present invention to provide an outboard motor provided with an internal combustion engine provided with an electrical equipment box disposed near the cylinder head of the internal combustion engine with respect to a direction parallel to the axes of cylinders, to increase freedom of arranging parts at positions farther from the cylinder head than the electrical equipment box and freedom of determining the sizes of those parts.

Another object of the present invention is to provide an outboard motor having a compact size with a narrow transverse width.

To attain the above objects, the present invention provides an outboard motor provided with an internal combustion engine including: a cylinder block provided with a plurality of in-line cylinders; a cylinder head joined to the cylinder block, the cylinder head defining combustion chambers respectively corresponding to the cylinders and provided with intake ports respectively opening into the combustion chambers; a vertical crankshaft having a vertical axis; and an electrical equipment box holding electrical equipment; the internal combustion engine having an intake-side part on one side of a vertical plane containing a horizontal center axis of the outboard motor with respect to a transverse direction and an exhaust-side part on the other side of the vertical plane: wherein an exhaust manifold passage for carrying exhaust gas from the combustion chambers is formed in a part of the cylinder head in the exhaust-side part on the side of the cylinder head with respect to a joint surface of the cylinder block joined to the cylinder head, an exhaust passage is formed in the cylinder block so as to connect to an outlet of the exhaust manifold passage in the joint surface, and the electrical equipment box is placed in the exhaust-side part so as to overlap the exhaust passage when viewed in a vertical direction.

According to the present invention, the exhaust manifold passage is on the side of the cylinder head with respect to the joint surface. Therefore, the electrical equipment box can be disposed so as to overlap the exhaust passage when viewed in vertical direction at a position adjacent to the cylinder head. Since an enlarged space is provided adjacent to the side of the electrical equipment box remote from the cylinder head, parts including inlet air silencer can be arranged in high freedom of arrangement in the enlarged space and large parts can be placed in the enlarged space and hence the outboard motor can be built in compact construction.

Typically, a vertical plane containing the axes of the cylinders is displaced from the vertical plane containing the horizontal center axis of the outboard motor or the center axis of the crankshaft toward the intake-side part.

Since the vertical plane containing the axes of the cylinders is thus displaced toward the intake-side part, the electrical equipment box can be disposed close to the vertical plane containing the horizontal center axis of the outboard motor. Consequently, the outboard motor can be built in a small transverse dimension.

Preferably, the internal combustion engine is provided with a starting motor having a starting-motor shaft with a pinion mounted thereon which is engageable with a ring gear formed in the circumference of a flywheel fixedly mounted on the crankshaft, and the starting motor is disposed such that a part of the starting motor on the side of the cylinder head with respect to a direction parallel to the axes of the cylinders overlaps the electrical equipment box with respect to the direction parallel to the axes of the cylinders or when viewed in the vertical direction.

Since the starting motor can be disposed near the cylinder head with respect to the direction parallel to the axes of the cylinder such that the part thereof on the side of the cylinder head overlaps the electrical equipment box, the starting motor disposed near the circumference of the flywheel does not protrude greatly in a transverse direction and hence the outboard motor can be built in a small transverse dimension.

DESCRIPTION OF THE PREFERRED EMBODIMENTS

An outboard motor S in a preferred embodiment according to the present invention will be described with reference to FIGS. 1 to 3.

Figure 1:
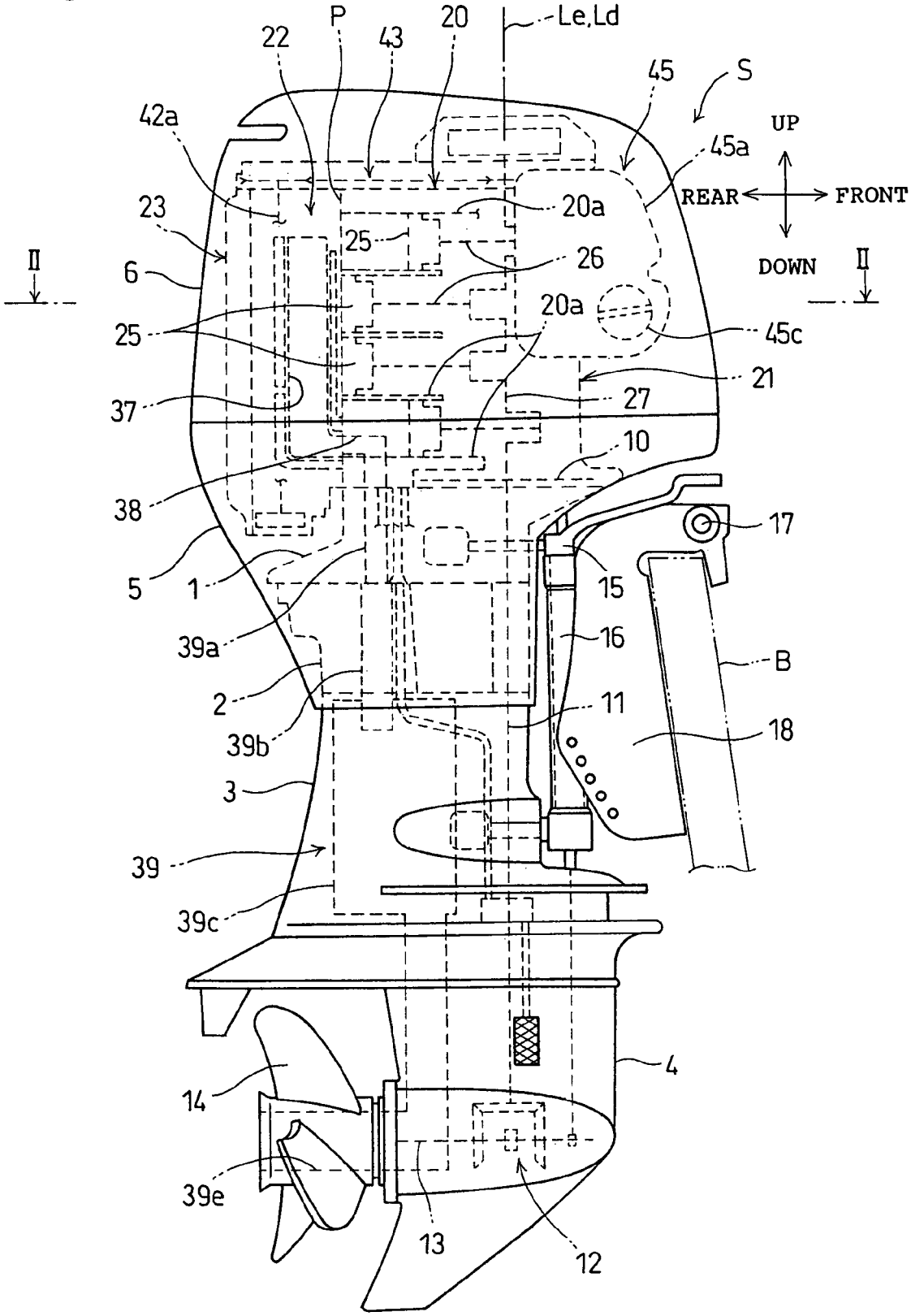
FIG. 1 is a schematic side elevation of an outboard motor in a preferred embodiment of the present invention taken from the right-hand side of the outboard motor.

Referring to FIG. 1, the outboard motor S to which the present invention is applied includes a vertical internal combustion engine E provided with a vertical crankshaft 27 having a vertical center axis $L_e$, a mount case 1 supporting the internal combustion engine E, an oil case 2 joined to the mount case 1, an extension case 3 joined to the oil case 2, a gear case 4 joined to the extension case 3, an under cover 5 covering a space extending between a lower part of the internal combustion engine E and an upper part of the extension case 3, and an engine cover 6 joined to the under cover 5.

Figure 2:
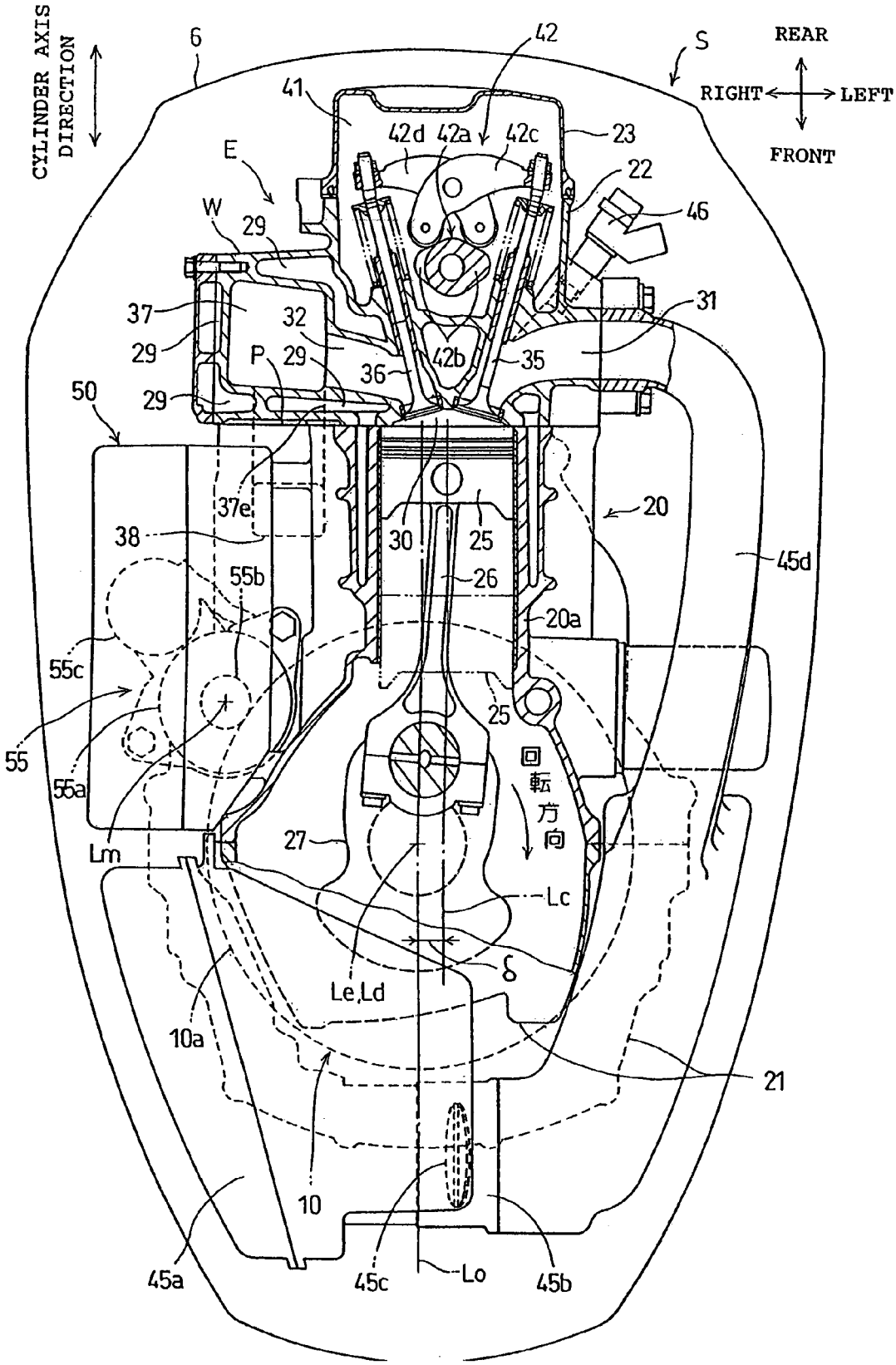
FIG. 2 is a sectional view taken on the line II-II in FIG. 1.

In this specification and appended claims, directions, parts and such modified by vertical, longitudinal, transverse, upper, lower, right and left are indicated by the arrows shown in FIGS. 1 and 2. In FIG. 1, the center axis $L_e$ is vertical.

The outboard motor S is provided with a transmission system including a drive shaft 11 connected to a flywheel 10 fixedly connected to a lower end part of the crankshaft 27 coaxially with the crankshaft 27, a reversing mechanism 12 held in the gear case 4, and a propeller shaft 13 fixedly mounted with a propeller 14. The power of the internal combustion engine E is transmitted from the crankshaft through the drive shaft 11, the reversing mechanism 12 and the propeller shaft 13 to the propeller 14 to drive the propeller 14 for rotation.

A mounting device for mounting the outboard motor S on the hull B of a ship includes a swivel shaft 15 fixed to the mount case 1 and the extension case 3, a swivel case 16 rotatably supporting the swivel shaft 15, a tilting shaft 17 supporting the swivel case 16 for tilting motions, and a bracket 18 holding the tilting shaft 17 and fixed to the transom of the hull B. The mounting device holds the outboard motor S on the hull B. The outboard motor S can be tilted on the tilting shaft 17 in a vertical plane and can be turned on the swivel shaft 1S in a horizontal plane.

Figure 3:
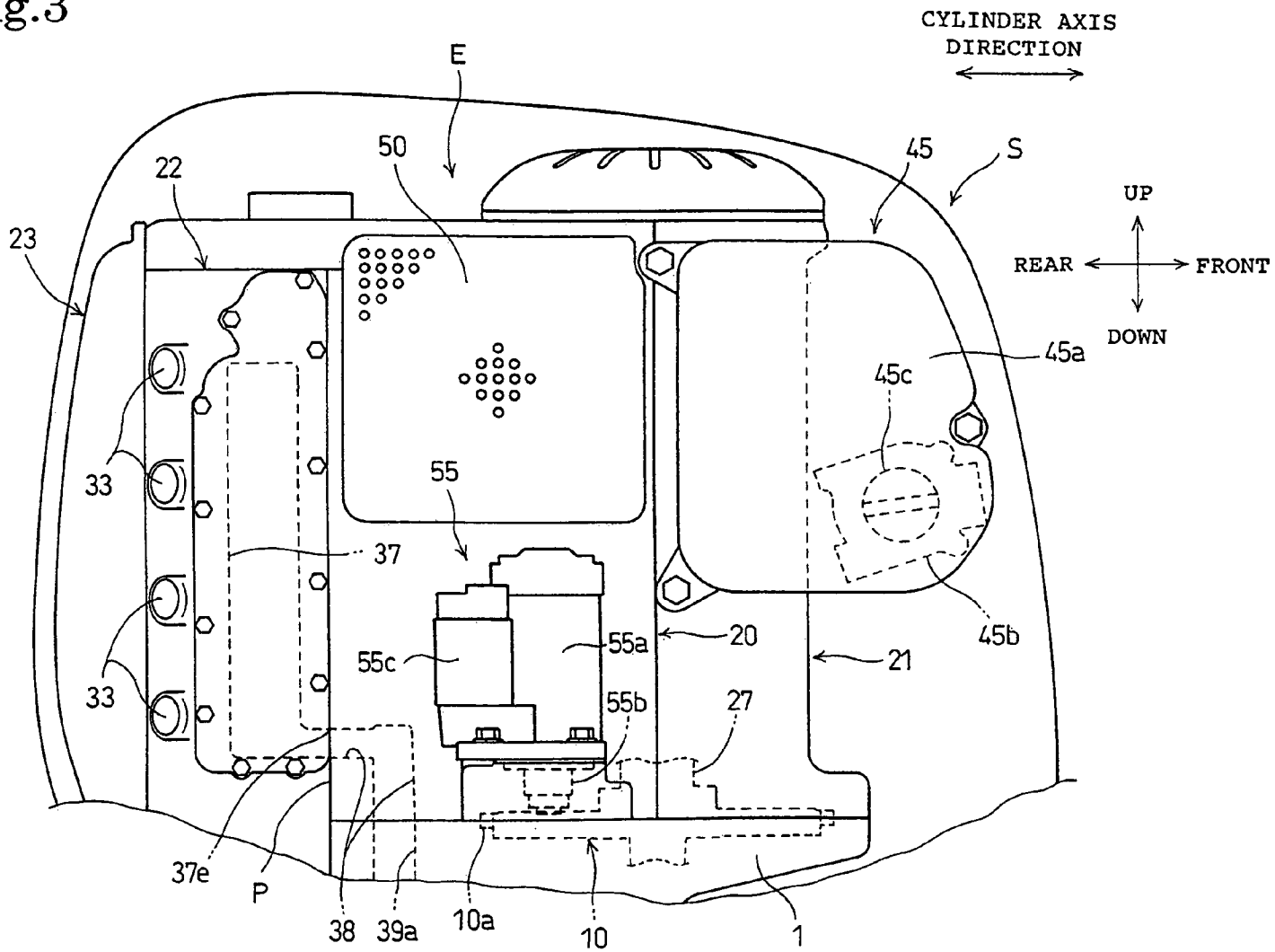
FIG. 3 is a side elevation of an internal combustion engine included in the outboard motor shown in FIG. 1.

Referring also to FIGS. 2 and 3, the internal combustion engine E, namely, a multicylinder 4-stroke internal combustion engine, included in the outboard motor S, has an engine body. The engine body includes a cylinder block 20 provided with four in-line cylinders 20*a* formed in a vertical arrangement, a crankcase 21 joined to the front end of the cylinder block 20, a cylinder head 22 joined to the rear end of the cylinder block 20, and a head cover or valve cover 23 joined to the rear end of the cylinder head 22. The cylinder head 22 is fastened to the joint surface P of the cylinder block 20 with bolts. The joint between the cylinder head 22 and the joint surface P of the cylinder block 20 is sealed with a gasket, not shown.

A piston 25 is axially slidably fitted in each of the cylinders 20*a* and is connected to the crankshaft 27 rotatably supported by cylinder block 20 and the crankcase 21 by a connecting rod 26. The cylinder head 22 is provided with combustion chambers 30 respectively corresponding to the cylinders 20*a* and opposed respectively to the pistons 25 with respect to a direction parallel to the axes $L_c$ of the cylinders 20*a*, intake ports 31 respectively opening into the combustion chambers 30, exhaust ports 32 respectively opening into the combustion chambers 30, and spark plug receiving openings 33 for receiving spark plugs, not shown, so that the spark plugs are exposed to the combustion chambers 30, respectively. Hereinafter, the direction parallel to the axes $L_c$ of the cylinders 20*a* (front-to-rear direction in this embodiment) will be referred to as "cylinder axis direction".

A vertical plane containing the axes $L_c$ of the cylinders 20*a* is displaced, in a direction from the top dead center of the piston 25 in the rotating direction of the crankshaft 27, from a vertical plane containing the center axis $L_e$ of the crankshaft 27; that is, the vertical plane containing the axes $L_c$ of the cylinders 20*a* is displaced by an offset δ toward the intake side of the internal combustion engine E. Thus the vertical plane containing the axes $L_c$ of the cylinders 20*a* is separated from the vertical plane containing the center axis $L_e$ of the crankshaft 27 toward the intake side of the internal combustion engine E by a distance corresponding to the offset δ. The vertical line containing the horizontal center axis $L_o$ of the outboard motor S contains the center axis $L_d$ of the drive shaft 11, which is aligned, in this embodiment, with the center axis $L_e$ of the crankshaft 27.

In the two parts of the engine body respectively on the opposite sides of the vertical plane containing the horizontal center axis $L_o$ of the outboard motor S, one part having the intake ports 32 is the intake-side part of the internal combustion engine E and the other part having an exhaust manifold passage 37 to be described later is the exhaust-side part of the internal combustion engine E.

The cylinder head 22 is provided with an intake valve 35 and an exhaust valve 36 respectively for opening and closing the intake port 31 and the exhaust port 32 for each cylinder 20*a*. An OHC valve train 42 disposed in a valve chamber 41 defined by the cylinder head 22 and the valve cover 23 drives the intake valves 35 and the exhaust valve 36 for opening and closing in synchronism with the rotation of the crankshaft 27. The valve train 42 includes a camshaft 42*a* provided with cams 42*b* and driven for rotation through a wrapping connector driving mechanism 43 (FIG. 1) by the crankshaft 27, intake rocker arms 42*c* driven for rocking by the cams 42*b* of the camshaft 42*a*, and exhaust rocker arms 42*d* driven for rocking by the cams 42*b* of the camshaft 42*a*. The cams 42*b* drive the intake valves 35 and the exhaust valves 36 for opening and closing through the intake rocker arms 42*c* and the exhaust rocker arms 42*d*, respectively.

The internal combustion engine E is provided with an intake system 45 including an inlet air silencer 45*a* having an air inlet, a throttle body 45*b* disposed in front of the crankcase 21, a throttle valve 45*c* placed in the throttle body 45*b*, and an intake manifold 45*d*. Air taken through the inlet air silencer 45*a* flows through the throttle body 45*b*. The intake manifold 45*d* carries air metered by the throttle valve 45*c* to the intake ports 31. The inlet air silencer 45*a* is adjacent to an electrical equipment box 50 with respect to the cylinder axis direction. The inlet air silencer 45*a* is disposed in a space extending on the opposite side of the cylinder head 22 with respect to the electrical equipment box 50, i.e., at a position in front of the electrical equipment box 50, in this embodiment, on the front side of the center axis $L_e$ with respect to the cylinder axis direction.

Intake air that flows through an intake passage in the intake system 45 is mixed with fuel injected by each of fuel injection valves 46 attached to the cylinder head 22 to produce an air-fuel mixture. The air-fuel mixture is taken through the intake port 31 into the combustion chamber 30. The air-fuel mixture is ignited by the spark plug and burns in the combustion chamber 30 to produce a combustion gas. The piston 25 is driven for reciprocation by the combustion gas and drives the crankshaft 27 for rotation through the connecting rod 36.

The combustion gas which has thus worked to drive the crankshaft 27 is discharged as an exhaust gas from the combustion chamber 30 through the exhaust port 32 into the exhaust manifold passage 37. The exhaust gas flows through the exhaust manifold passage 37, an exhaust passage 38 formed in the cylinder block 20, a passage 39*a* formed in the mount case 1, and an exhaust gas guide passage 39 including a passage 39*b* defined by an exhaust pipe and an expansion chamber 39*c*. Then, the exhaust gas is discharged through a passage 39*e* formed in the boss of the propeller 14 into the water. The exhaust passage 38 is an L-shaped passage having a horizontal section connected to an exhaust gas outlet 37*e*, and a vertical section extending vertically downward and connected to the passage 39*a*

The exhaust gas discharged through the exhaust ports 32 from the combustion chambers 30 collects in the exhaust manifold passage 37. The exhaust manifold passage 37 is defined by passage walls W formed integrally with the exhaust-side part of the cylinder head 22. The passage walls W defining the exhaust manifold passage 37 and water jackets 29 are disposed nearer to the cylinder head 22 than the joint surface P of the cylinder block 20 to which the cylinder head 22 is joined with respect to the cylinder axis direction.

The L-shaped exhaust passage 38 (FIGS. 1 and 3) is formed in a lower end part of the cylinder block 20. The exhaust passage 38 has an inlet opening in the joint surface P and connected to the exhaust gas outlet 37*e* of the exhaust manifold passage 37, and an outlet connected to the passage 39*a* (see also FIG. 1) formed in the mount case 1. The exhaust passage 38 is nearer to the cylinder head 22 than the piston 25 at the bottom dead center as indicated by two-dot chain lines in FIG. 2 with respect to the cylinder axis direction.

Referring to FIGS. 2 and 3, the internal combustion engine E is provided with the electrical equipment box 50 that holds therein electrical equipment including an electronic control unit (ECU), and a starting motor 55 for driving the crankshaft 27 through the flywheel 10 to start the internal combustion engine E.

The electrical equipment box 50 is fixed to an upper part of the exhaust-side part of the cylinder block 20 and overlaps the exhaust passage 38 when viewed in vertical direction. More concretely, the electrical equipment box 50 is disposed between the center axis $L_e$ and the joint surface P with respect to the cylinder axis direction. A part of the electrical equipment box 50 near the cylinder head 22 overlaps the piston 25 at the top dead center indicated by continuous lines in FIG. 2 and the piston 25 at the bottom dead center with respect to the cylinder axis direction.

The starting motor 55 has a body 55*a* which supports a starting-motor shaft fixedly mounted with a pinion 55*b* capable of being engaged with a ring gear 10*a* formed in the circumference of the flywheel 10, and a magnetic switch 55*c* attached to the body 55*a*. The magnetic switch 55*c* advances the pinion 55*b* axially to engage the pinion 55*a* with the ring gear 10*a* and retracts the pinion 55*b* axially to disengage the pinion 55*a* from the ring gear 10*a*.

The magnetic switch 55*c*, a part of the starting motor 55 near the cylinder head 22 with respect to the cylinder axis direction, overlaps the electrical equipment box 50 with respect to the cylinder axis direction or when viewed in the vertical direction. More concretely, the entire starting motor 55 overlaps the electrical equipment box 50 with respect to the cylinder axis direction and is nearer to the horizontal center axis $L_o$ of the outboard motor S than the electrical equipment box 50 with respect to the transverse direction.

Therefore, an entire part of the starting motor 55 nearer to the cylinder head 22 than the center axis $L_m$ of the pinion 55*b* with respect to the cylinder axis direction overlaps the electrical equipment box 50. The entire magnetic switch 55*c* overlaps the electrical equipment box 50 with respect to the cylinder axis direction or when viewed in vertical direction. The magnetic switch 55*c* overlaps the piston 25 at the bottom dead center or is nearer to the cylinder head 22 than the piston 25 at the bottom dead center with respect to the cylinder axis direction.

The operation and effect of the outboard motor S will be described.

In the outboard motor S provided with the internal combustion engine E, the exhaust manifold passage 37 is formed in the exhaust side part of the cylinder head 22, the exhaust passage 38 connecting to the exhaust gas outlet 37*e* in the joint surface P is formed in the cylinder block 20, and the electrical equipment box 50 on the exhaust side overlaps the exhaust passage 38 formed in the cylinder block 20 when viewed in vertical direction. Since the exhaust manifold passage 37 is nearer to the cylinder head 22 than the joint surface P with respect to the cylinder axis direction, the electrical equipment box 50 can be disposed close to the cylinder head 22 with respect to the cylinder axis direction so as to overlap the exhaust passage 38 when viewed in vertical direction. Consequently, an enlarged space is provided on the side of the electrical equipment box 50 opposite the cylinder head 22 with respect to the cylinder axis direction. The enlarged space increases the freedom of arranging parts including the inlet air silencer 45*a*. Thus the inlet air silencer 45*a* having an increased silencing capacity can be placed in the enlarged space without increasing the size of the outboard motor S.

The vertical plane containing the axes $L_c$ of the cylinders 20*a* is displaced by the offset δ toward the intake side from the vertical plane containing the horizontal center axis $L_o$ and the center axis $L_e$ of the crankshaft 27 and hence the distance between the electrical equipment box 50 and the vertical plane containing the horizontal center axis $L_o$ can be reduced accordingly. Consequently, the outboard motor S can be formed in a small transverse width.

Since the part of the starting motor 55 near the cylinder head 22 with respect to the cylinder axis direction overlaps the electrical equipment box 50 with respect to the cylinder axis direction (or when viewed in the vertical direction), the starting motor 55 can be disposed near the cylinder head 22 with respect to the cylinder axis direction such that the part of the starting motor 55 near the cylinder head 2 overlaps the electrical equipment box 50 with respect to the cylinder axis direction, in other words, when viewed in vertical direction. Consequently, the starting motor 55 disposed near the circumference of the flywheel 10 does not protrude greatly in the transverse direction and hence the outboard motor S has a small transverse width. Since the starting motor 55 is disposed nearer to the vertical plane containing the horizontal center axis $L_o$ than the electrical equipment box 50 and the entire starting motor 55 overlaps the electrical equipment box 50, the outboard motor S can be built in compact construction.

Possible changes that can be made in the outboard motor S in the preferred embodiment described above to provide modifications will be described.

The vertical plane containing the axes $L_c$ of the cylinders 20*a* may contain the center axis $L_e$ of the crankshaft 27, and the center axis $L_e$ of the crankshaft 27 may be displaced from the horizontal center axis $L_o$ of the outboard motor S by, for example, the offset δ.

What is claimed is:

1. An outboard motor provided with an internal combustion engine including: a cylinder block provided with a plurality of in-line cylinders; a cylinder head joined to the cylinder block, the cylinder head defining combustion chambers respectively corresponding to the cylinders and provided with intake ports respectively opening into the combustion chambers; a vertical crankshaft having a vertical axis; and an electrical equipment box holding electrical equipment; the internal combustion engine having an intake-side part on one side of a vertical plane containing a horizontal center axis of the outboard motor with respect to a transverse direction and an exhaust-side part on the other side of the vertical plane:

wherein an exhaust manifold passage for carrying exhaust gas from the combustion chambers is formed in a part of the cylinder head in the exhaust-side part on the side of the cylinder head with respect to a joint surface of the cylinder block joined to the cylinder head, an exhaust passage is formed in the cylinder block so as to connect to an outlet of the exhaust manifold passage in the joint surface, and the electrical equipment box is placed in the exhaust-side part so as to overlap the exhaust passage when viewed in a vertical direction.

2. The outboard motor according to claim 1, wherein a vertical plane containing the axes of the cylinders is displaced from the vertical plane containing the horizontal center axis of the outboard motor or the center axis of the crankshaft toward the intake-side part.

3. The outboard motor according to claim 2, wherein the internal combustion engine is provided with a starting motor having a starting-motor shaft with a pinion mounted thereon capable of being brought into engagement with a ring gear formed in a circumference of a flywheel fixedly mounted on the crankshaft, and disposed such that a part thereof on the side of the cylinder head with respect to a direction parallel to the axes of the cylinders overlaps the electrical equipment box with respect to a direction parallel to the axes of the cylinders).

4. The outboard motor according to claim 1, wherein the exhaust manifold passage extends vertically, the exhaust gas outlet is at a lower end of the exhaust manifold passage, the exhaust passage is an L-shaped passage having a horizontal section and a vertical section.

5. The outboard motor according to claim 4, wherein the starting motor underlies the electrical equipment box.

* * * * *